US012270291B2

(12) United States Patent
Uffmann

(10) Patent No.: US 12,270,291 B2
(45) Date of Patent: Apr. 8, 2025

(54) METHOD FOR MONITORING OVERBURDEN WHEN ADVANCE WORKING IN THE GROUND, AND ADVANCE-WORKING DEVICE

(71) Applicant: HERRENKNECHT AG, Schlehenweg (DE)

(72) Inventor: Hans-Peter Uffmann, Aachen (DE)

(73) Assignee: Herrenknecht, Schwanau (DE)

( * ) Notice: Subject to any disclaimer, the term of this patent is extended or adjusted under 35 U.S.C. 154(b) by 0 days.

(21) Appl. No.: 18/696,208

(22) PCT Filed: Sep. 9, 2022

(86) PCT No.: PCT/DE2022/100666

§ 371 (c)(1),
(2) Date: Mar. 27, 2024

(87) PCT Pub. No.: WO2023/051865

PCT Pub. Date: Apr. 6, 2023

(65) Prior Publication Data

US 2024/0418072 A1 Dec. 19, 2024

(30) Foreign Application Priority Data

Sep. 29, 2021 (DE) ..... 10 2021 125 286.5

(51) Int. Cl.

| | |
|---|---|
| ***E21B 44/02*** | (2006.01) |
| ***E21B 4/00*** | (2006.01) |
| ***E21B 47/008*** | (2012.01) |
| ***E21B 47/06*** | (2012.01) |

(52) U.S. Cl.
CPC ..... *E21B 44/02* (2013.01); *E21B 4/00* (2013.01); *E21B 47/008* (2020.05); *E21B 47/06* (2013.01)

(58) Field of Classification Search
CPC ..... E21B 44/02; E21B 47/008; E21B 4/00; E21B 47/06; E21D 9/00
See application file for complete search history.

(56) References Cited

U.S. PATENT DOCUMENTS

| | | | | |
|---|---|---|---|---|
| 4,040,666 A * | 8/1977 | Uchida | E21D 9/13 175/48 |
| 4,152,027 A | 5/1979 | Fujimoto et al. | |
| 4,167,290 A * | 9/1979 | Yamazaki | E21F 17/00 299/30 |

(Continued)

FOREIGN PATENT DOCUMENTS

| | | |
|---|---|---|
| JP | S59185297 A | 4/1984 |
| JP | 59154293 A | 9/1984 |

(Continued)

*Primary Examiner* — Taras P Bemko
(74) *Attorney, Agent, or Firm* — Mark Rodgers

(57) ABSTRACT

A method for monitoring overburden during excavation in soil, in which the soil pressure exerted by the soil (10) on an excavation device driven through the soil (10) is monitored by means of a pressure control element (5) extended from the circumference (3) of the driving device. An excavation device for carrying out the method has a pressure control element (5) which is arranged on the circumference (3) of the excavation device and can be extended beyond the circumference (3) of the excavation device.

13 Claims, 1 Drawing Sheet

(56) References Cited

U.S. PATENT DOCUMENTS

Figure 1:
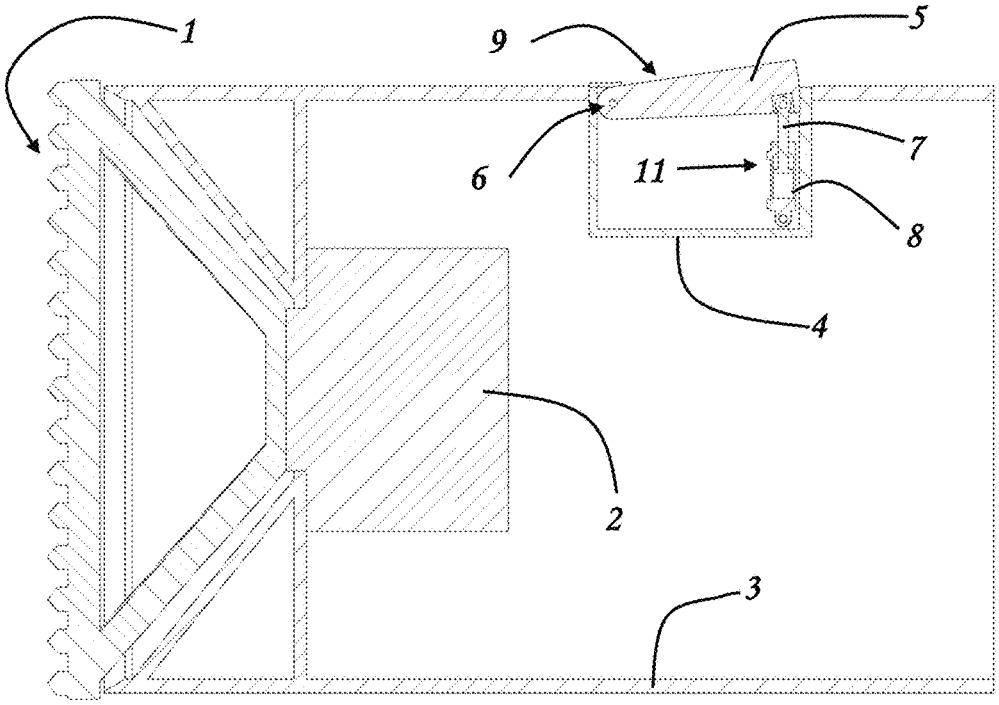

| | | | | | |
|---|---|---|---|---|---|
| 4,774,470 | A * | 9/1988 | Takigawa | E21D 9/003 175/50 |
| 5,330,292 | A * | 7/1994 | Sakanishi | G08C 23/00 342/135 |
| 6,554,368 | B2 * | 4/2003 | Drake | E21D 9/093 299/8 |

FOREIGN PATENT DOCUMENTS

| | | | |
|---|---|---|---|
| JP | 11107684 | A | 4/1999 |
| JP | 3821538 | B2 | 9/2006 |

* cited by examiner

METHOD FOR MONITORING OVERBURDEN WHEN ADVANCE WORKING IN THE GROUND, AND ADVANCE-WORKING DEVICE

The invention relates to a method for monitoring overburden during excavation in soil and to an excavation device suitable for carrying out the method.

The underground installation of pipes using pipe jacking has been a tried and tested civil engineering technique for many decades. Thanks to the progress made in the last 30 years in particular, tunnels of up to 1000 m in length and diameters of up to almost 5 meters can now be successfully completed. The main difference between the tunnelling techniques is the way in which the soil or rock is excavated at the so-called face. The excavated material, referred to below as overburden, can be transported from the face to the starting shaft in various ways, e.g. in buckets, by screw conveyor or by flushing conveyance with water.

For all methods, it is important to balance the rate of advance with the amount of excavated material. Over-extraction of excavated material is often problematic, especially when driving in unstable soils below groundwater. If the volume of excavated material in the ground exceeds the volume of the device inserted into the ground using the method, depending on the amount of the over-extraction, this can lead to subsidence or even large surface failures, which can result in considerable damage to structures on the surface, roads and any possibly present underground infrastructure. Depending on the overlying soils and the depth of the tunnel, this damage often occurs with a considerable time delay.

It is known to monitor the volume of overburden removed. However, this does not achieve the accuracy required to reliably prevent the undesirable consequences of over-extraction. Known methods include determining the volume and density of the excavated overburden. In the case of hydraulic conveying, volume monitoring is also complex because a separation system is required to separate the overburden from the conveying liquid. It is also common practice to use belt scales or simply measure the volume of overburden conveyed. In addition to the associated measurement inaccuracies, all methods have the additional source of error that it is virtually impossible to in-situ determine the exact compactness of the soil to be excavated. All in all, this can lead to a considerable additional amount of soil being removed.

The invention is based on the technical problem of providing a method and an excavation device of the type mentioned at the beginning, with which an excessively high extraction rate of overburden can be detected at an early stage more reliably than according to the state of the art.

The technical problem is solved with regard to the method with the features of claim 1 and with regard to the excavation device with the features of claim 5. Preferred embodiments of the method according to the invention and of the excavation device according to the invention are shown in the dependent claims.

With regard to the method, it is therefore proposed that the pressure exerted by the soil on an excavation device driven through the soil is monitored by means of a pressure control element that can be extended from the circumference of the excavation device in order to monitor the excavated material during excavation in soil. This prevents inaccurate measurement of the quantity or volume of overburden. The pressure control can be used to determine whether the surrounding soil is becoming increasingly loose, which could indicate that too much soil has been excavated in relation to the rate of advance. In this case, for example, the rate of advance can be increased and/or the amount of overburden extracted per unit of time can be reduced. The excavation device can be any type of machine, e.g. a fullface-tunneling machine or a roadheader. The use of the method is also independent of the type of conveying of the excavated soil, e.g. by means of a conveying bucket, screw conveyor or flushing conveyance.

The pressure control element can have various geometries. For example, a pressure control element is conceivable whose outer wall, when not extended, continues the shape of the peripheral wall forming the circumference of the excavation device and which performs a swivel movement to extend. The pressure control element could thus, for example, protrude from the circumferential wall of the excavation device in a fin-like manner when extended.

Not every soil composition may be problem-free for the implementation of the inventive method. However, the method can be adapted to different soil compositions. It is not necessary for the inventive method to detect minute pressure changes in the soil pressure in order to react to them with changes in the rate of advance and/or the amount of overburden conveyed per unit of time. The method according to the invention is already effective if a strong decrease in soil pressure can be detected, which indicates an over-extraction of soil.

The method according to the invention can be carried out in such a way that the pressure control element is preferably moved hydraulically or pneumatically.

The method according to the invention can be carried out in such a way that a change in the soil pressure is detected by measuring the pressure in a pressure medium used in the hydraulic or pneumatic system and/or by changing the position of the pressure control element.

If too much soil is removed, the soil pressure on the excavation device and therefore on the pressure control element is reduced. As a result, the pressure control element tends to move outwards, which leads to a reduction in pressure in the pressure medium, which can be water or oil, for example.

In order to be able to detect a reduction in the soil pressure, the pressure control element protrudes at least partially from the circumferential wall of the excavation device, e.g. by a value of up to 30 mm or more. In order to keep the position of the pressure control element stable despite a reduction in the soil pressure, the pressure of the pressure medium is automatically adjusted, i.e. reduced, and preferably when the pressure falls below a limit value or a pressure change occurs, a signal is automatically emitted or an action is triggered in order to reduce the rate of advance and/or the amount of overburden conveyed per unit of time. If the pressure control element detects a sufficient increase in soil pressure, the rate of advance and/or the amount of overburden conveyed per unit of time can be increased again.

Alternatively, a change in the position of the pressure control element can be detected at a preset initial pressure of the pressure medium. First, the pressure control element can be moved to an initial position in which the pressure control element protrudes at least partially from the circumferential wall of the excavation device, e.g. by up to 20 mm or up to 50 mm. Larger values are also possible. The pressure control element is preferably blocked against movement out of the starting position towards the inside of the excavation device, so that up to a maximum load only movement into the ground or from there back to the starting position is possible.

A pressure relief valve, for example, can be used to prevent damage if the maximum load is exceeded.

The initial pressure can be selected depending on the soil condition and/or the soil composition. It may be advantageous to set the output pressure so that it is a fraction of the passive soil pressure, e.g. at most 20%, further preferably at most 10% or further preferably at most 5%. In this case, only a localized massive reduction of the passive soil pressure in the ground allows the pressure control element to move outwards, which is a strong indication of significant over-extraction. Since, in an advantageous embodiment of the method according to the invention, only a small fraction of the passive soil pressure is selected for the output pressure, this does not necessarily have to be determined precisely in advance. Rather, a rough estimate of the passive earth pressure with known or assumed soil compositions may be sufficient.

This means that the earth pressure on the excavation device can be monitored by measuring the pressure in the pressure medium and/or by measuring the change in position or displacement on the pressure control element. The term soil pressure generally refers to the pressure exerted by the soil under the given conditions on a surface, here in particular the excavation device, and is used here to distinguish it from the technical terms "passive soil pressure" and "active soil pressure".

The pressure control element is preferably arranged in the area of the crown, i.e. at an upper point of the excavation device, as this is where a reduction in soil pressure due to over-extraction is most noticeable.

The pressure control element should preferably be installed as close as possible behind the tip of the machine in order to detect over-extraction of the soil at an early stage.

In the following, an exemplary embodiment of the method according to the invention and of the excavation device according to the invention is illustrated by means of figures.

It shows

FIG. 1: Lateral cross-section of the front end of an excavation device with pressure control element, FIG. 2: in an enlarged section of the excavation device according to FIG. 1 the pressure control element in the retracted state, FIG. 3: the pressure control element according to FIG. 2 in the retracted state in axial cross-section, and FIG. 4: Lateral cross-section of the pressure control element according to FIG. 2 in the extended state.

FIG. 1 shows schematically in lateral cross-section the front part of a tubular excavation device having a peripheral wall 3 with a drill head 1 and a motor unit 2 for driving the drill head 1. The peripheral wall 3 can be formed by a cutting shoe in a controlled bore. A wedge-shaped pressure control element 5 is arranged in a box-shaped receptacle 4 fixed to the peripheral wall 3 so that it can pivot about a pivot axis 6. The pressure control element 5 is articulated to a piston 7 of a hydraulic cylinder 8. Via the hydraulic cylinder 8 and the piston 7, in their entirety referred to below as hydraulic system 11, the pressure control element 5 can be brought into an extended position in which an upper contact surface 9 of the pressure control element 5 projects at least partially beyond the circumference of the peripheral wall 3.

Figure 2:
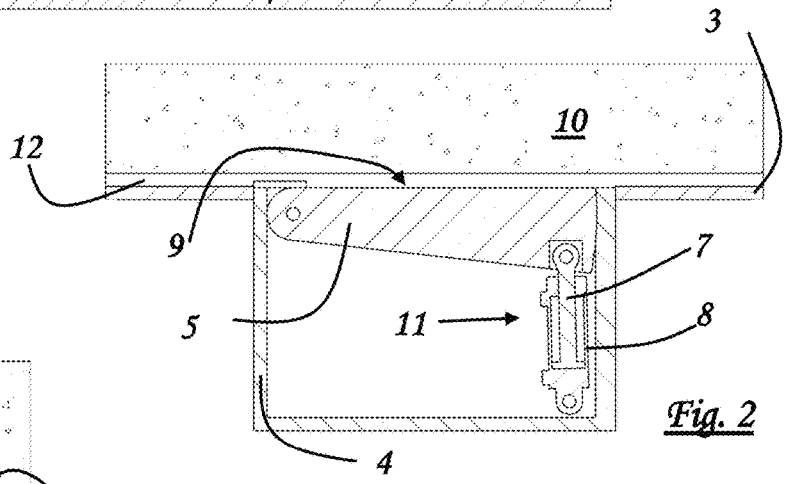
Figure 3:
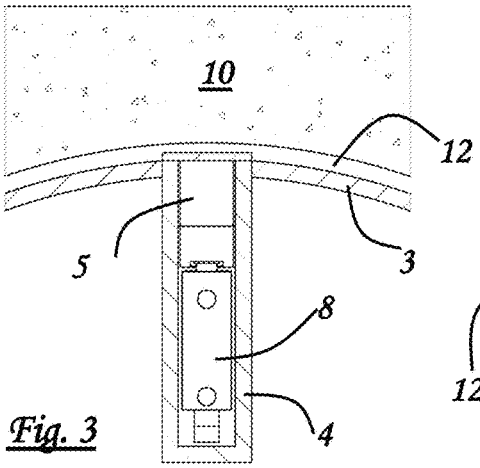
Figure 4:
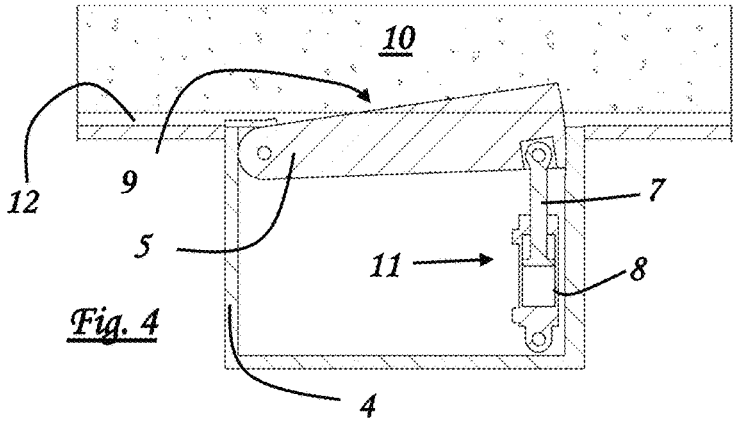

FIG. 2 shows an enlarged section of the excavation device with the box-shaped receptacle 4, the pressure control element 5, the piston 7 and the hydraulic cylinder 8 together with the soil 10 surrounding the excavation device. In the retracted state, the contact surface 9 of the pressure control element 5 is essentially flush with the circumference of the peripheral wall 3. FIG. 3 shows the situation according to FIG. 2 in axial cross-section. FIG. 4 shows the pressure control element 5 in an extended position corresponding to FIG. 2, in which the contact surface 9 of the pressure control element 5 protrudes into the soil 10.

The exemplary procedure is as follows: From a starting pit not shown here, the excavation device is driven into the soil 10, for example with a rotating drill head 1. The drill head 1 has a slight overcut in relation to the circumference of the peripheral wall 3 of the excavation device. For example, lubricating material 12, for example bentonite, can be introduced into an intermediate space created by the overcut via lines not shown here and openings in the circumferential wall 3, which reduces the friction of the peripheral wall 3 against the soil 10.

Excavated soil 10, i.e. the overburden, can be removed towards the starting pit with the addition of a liquid, for example water, via hoses not shown here. Alternative types of removal are also possible, for example via a screw or bucket conveyor arranged inside the excavation device, which is also not shown here. When the excavation device penetrates the soil 10 or shortly thereafter, the pressure control element 5 is brought into an extended position by means of the hydraulic system 11 (see FIG. 1 and FIG. 4) so that the contact surface 9, which is preferably flat but can also take on other shapes, comes into contact with the surrounding soil 10.

When the pressure control element 5 is extended, the pressure of a pressure medium in the hydraulic system 11 is set so that there is a balance between the torques that are exerted on the pressure control element 5 via the pressure of the soil 10 on the one hand and via the piston 7 on the other. If the pressure of the soil 10 decreases, the pressure in the hydraulic system 11 must be reduced accordingly to maintain the position of the pressure control element 5, so that the reduction in soil pressure can be determined via the pressure in the hydraulic system 11. Such a reduction in the soil pressure indicates that an over-extraction of soil 10 has occurred, so that as a countermeasure, for example, the delivery rate of the excavated material can be reduced and/or the advance of the excavation device can be increased in order to prevent subsidence or undesired loosening of the soil 10.

As an alternative to measuring the pressure in the hydraulic system 11 or parallel to this, the extension length of the piston 7 or the position of the pressure control element 5 relative to other parts of the excavation device, e.g. to the circumferential wall 3, can also be measured using suitable methods in order to determine a change in the earth pressure exerted on the pressure control element 5 by the soil 10. For this purpose, an initial pressure can be set in the hydraulic system to which a fraction of, for example, 10% of the passive earth pressure of the surrounding soil 10 is applied. From an initial position of the pressure control element 5, in which the pressure control element 5 protrudes with its contact surface 9 from the peripheral wall 3 of the excavation device, e.g. by a maximum of 30 mm, the pressure control element 5 is then pressed outwards when the soil pressure is less than 10% of the passive soil pressure. This movement can be used to detect over-extraction of overburden in the soil 10.

In order to prevent soil 10 from entering the receptacle 4, the receptacle 4 can be filled with a material, for example bentonite, which does not hinder the functions of the hydraulic system 11. This is preferably under a pressure at least substantially corresponding to the pressure of the lubricating material 12 in order to prevent the ingress of the lubricating material 12, which may be mixed with soil 10.

It is also possible to move the pressure control element 5 with a translational movement rather than just pivoting it.

The features of the device and of the method illustrated in the embodiment examples shown can be replaced or supplemented in the sense of the invention by alternative or further features, such as those shown in the general part of the description or which are apparent to a person skilled in the art.

LIST OF REFERENCE SYMBOLS

1 drill head
2 motor unit
3 peripheral wall
4 receptacle
5 pressure control element
6 pivot axis
7 piston
8 hydraulic cylinder
9 contact surface
10 soil
11 hydraulic system
12 lubricating material

The invention claimed is:

1. Method for drilling a hole in the soil for the installation of pipes, comprising;
- driving an excavation device with a rotating drill head and a peripheral wall into the soil from a starting pit,
- transporting the overburden released from the drill head away in the direction of the starting pit
- providing a pressure control element for controlling the removal quantity of the overburden during driving in the soil, by monitoring the soil pressure exerted by the soil on the excavation device, wherein the pressure control element is arranged in a box-shaped receptacle pivotable about a pivot axis, wherein the pressure control element is wedge-shaped and has a contact surface, and wherein the pressure control element is connected to a piston of a hydraulic cylinder,
- pivoting, with the hydraulic cylinder, the pressure control element into an extended position projecting from the peripheral wall whereby after the penetration of the excavation device into the soil the contact surface comes into contact with the surrounding soil.

2. Method according to claim 1, wherein the pressure control element is moved at least one of hydraulically or pneumatically.

3. Method according to claim 2, further comprising detecting a change in the soil pressure by at least one of
- measuring the pressure in a pressure medium used in at least one of the pneumatic or hydraulic system, or
- measuring a change in position of the pressure control element.

4. Method according to claim 1, wherein the pressure medium is subjected to a fraction, at least one of at most 20%, at most 10%, or at most 5% of the passive earth pressure of the surrounding earth.

5. Method according to claim 1, further comprising adjusting the pressure of a pressure medium acting in the hydraulic cylinder to maintain the extended position.

6. Method according to claim 5, wherein when at least one of the pressure falls below a limit value or a pressure change occurs at least one of a signal is automatically emitted, or an action is triggered in order to at least one of reduce the rate of advance or the amount of overburden conveyed per unit of time.

7. Method according to claim 1, further comprising;
- presetting an output pressure of the pressure medium, and
- detecting a change in the position of the pressure control element.

8. Excavation device, comprising:
- a drill head,
- a motor unit for driving the drill head
- a peripheral wall, having a pressure control element which is arranged on the peripheral wall, which can be extended beyond the circumferential wall of the excavation device and is arranged in the region of a crown of the excavation device, wherein;
- the pressure control element is arranged in a box-shaped receptacle to be pivotable about a pivot axis,
- the pressure control element is wedge-shaped and has a contact surface,
- the pressure control element is connected to a piston of a hydraulic cylinder, via which the pressure control element can be brought into an extended position, and
- the contact surface projects at least partially beyond the circumference of the peripheral wall in the extended position of the pressure control element,
- wherein the excavation device is configured to;
- drive the drill head and the peripheral wall into the soil from a starting pit,
- transport the overburden released from the drill head away in the direction of the starting pit,
  - wherein the pressure control element is configured to control the removal quantity of the overburden during driving in the soil by monitoring the soil pressure exerted by the soil on the excavation device,
- pivot the pressure control element into an extended position projecting from the peripheral wall by the hydraulic cylinder,
- whereby the contact surface comes into contact with the surrounding soil after the penetration of a jacking device into the soil.

9. Excavation device according to claim 8, wherein the pressure control element is at least one of pneumatically or hydraulically operated.

10. Excavation device according to claim 9, further comprising a pressure measuring element configured to measure a pressure medium in the pneumatic or hydraulic system.

11. Excavation device according to claim 8, further comprising a position measuring element configured to measure the position or a change in position of the pressure control element.

12. Excavation device according claim 8, wherein the contact surface of the pressure control element is flush with the peripheral wall in the retracted state.

13. Excavation device according claim 8, wherein the contact surface of the pressure control element projects into the soil.

* * * * *